US010662720B2

(12) United States Patent
Wurster et al.

(10) Patent No.: US 10,662,720 B2
(45) Date of Patent: May 26, 2020

(54) MAST WITH RACK ASSEMBLY

(71) Applicant: Harnischfeger Technologies, Inc., Wilmington, DE (US)

(72) Inventors: Andrew Wurster, New Berlin, WI (US); Samuel Haworth, Oak Creek, WI (US); Russ Cascio, Glendale, WI (US); Tim Bachinski, Cudahy, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 288 days.

(21) Appl. No.: 15/712,672

(22) Filed: Sep. 22, 2017

(65) Prior Publication Data

US 2018/0087326 A1 Mar. 29, 2018

Related U.S. Application Data

(60) Provisional application No. 62/399,072, filed on Sep. 23, 2016.

(51) Int. Cl.

| | |
|---|---|
| ***E21B 15/04*** | (2006.01) |
| ***E21B 19/14*** | (2006.01) |
| ***E21B 17/046*** | (2006.01) |
| ***E21B 7/04*** | (2006.01) |
| ***E21B 4/00*** | (2006.01) |
| ***E21B 19/083*** | (2006.01) |
| ***E21B 7/02*** | (2006.01) |

(52) U.S. Cl.

CPC ..... *E21B 15/04* (2013.01); *E21B 4/006* (2013.01); *E21B 7/02* (2013.01); *E21B 7/04* (2013.01); *E21B 17/046* (2013.01); *E21B 19/083* (2013.01); *E21B 19/14* (2013.01)

(58) Field of Classification Search

CPC . E21B 7/02; E21B 15/04; E21B 19/14; E21B 4/006; E21B 17/046

USPC ..... 173/184

See application file for complete search history.

(56) References Cited

U.S. PATENT DOCUMENTS

| | | | | |
|---|---|---|---|---|
| 1,502,383 A * | 7/1924 | Guerrini | E21C 11/00 | 173/39 |
| 3,645,343 A | 2/1972 | Mays | | |
| 3,867,989 A | 2/1975 | Hisey et al. | | |
| 3,920,087 A | 11/1975 | Hisey et al. | | |
| 4,830,336 A | 2/1989 | Herabakka | | |
| 5,094,302 A * | 3/1992 | Back | E21B 7/02 | 173/148 |
| 5,794,724 A * | 8/1998 | Moller | B25H 1/0064 | 175/170 |
| 8,671,626 B1 * | 3/2014 | Marty | E21B 15/04 | 175/85 |

OTHER PUBLICATIONS

Examination Report issued from the Chilean Patent Office for related Application No. 201702395 dated Jan. 28, 2019 (10 pages including Statement of Relevance).

* cited by examiner

*Primary Examiner* — Robert F Long
*Assistant Examiner* — Xavier A Madison
(74) *Attorney, Agent, or Firm* — Micheal Best & Friedrich LLP

(57) ABSTRACT

A mast and rack assembly for a mining machine includes a mast and a rack assembly coupled to the mast. The rack assembly includes outer rails and rack segments disposed between the outer rails and the mast. At least one of the outer rails overlaps two of the rack segments.

24 Claims, 7 Drawing Sheets

MAST WITH RACK ASSEMBLY

CROSS-REFERENCE TO RELATED APPLICATIONS

This application claims priority to U.S. Provisional Application No. 62/399,072, filed Sep. 23, 2016, the entire contents of which are incorporated herein by reference.

FIELD OF THE INVENTION

The present invention relates to drill rigs, and more specifically to a rack structure on a mast of a drill rig.

Blasthole drill rigs are commonly used in the mining industry to drill through hard rock. Blasthole drill rigs can be found, for example, in coal, copper, and diamond mines throughout the world. A blasthole drill rig typically includes a base, a drill tower (e.g., a mast) extending vertically from the base, a drill pipe or pipes that are coupled to and supported by the drill tower and extend into a borehole, a drill bit coupled to one end of the drill pipe or pipes within the borehole, a drill head coupled to the other end of the drill pipe or pipes, and a driving mechanism coupled to the drill tower that moves the drill head and associated drill pipe up and down in a controlled fashion relative to the drill tower.

Current driving mechanisms include a rack structure with rack segments that are placed in abutting relationship relative to one another along the mast and are welded in place onto the mast. The rack structures engage a pinion to move the drill pipe.

SUMMARY

In accordance with one construction, a mast and rack assembly includes a mast and a rack assembly coupled to the mast. The rack assembly includes outer rails and rack segments disposed between the outer rails and the mast. At least one of the outer rails overlaps two of the rack segments.

In accordance with another construction, a blasthole drill includes a base, crawlers coupled to the base and configured to drive the blast hole drill, a mast coupled to the base, a drill pipe coupled to the mast, and a rack assembly coupled to the mast. The rack assembly includes inner rails pressed against a wall of the mast, outer rails spaced from the inner rails, and rack segments disposed between the outer rails and the mast. At least one of the outer rails overlaps two of the rack segments, and at least one of the inner rails overlaps two of the rack segments.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited.

DETAILED DESCRIPTION

Figure 1:
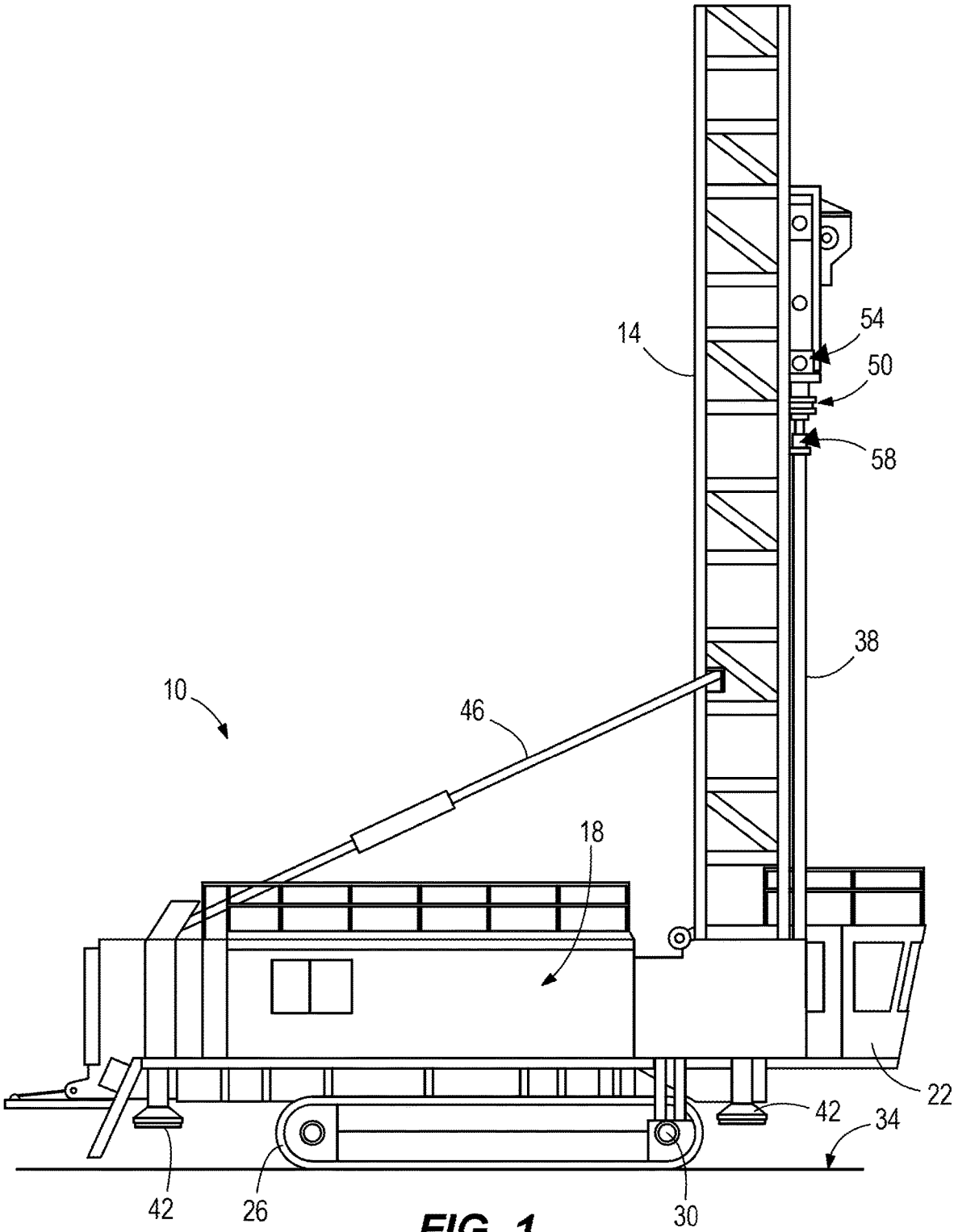
FIG. 1 is a schematic side view of a drill rig.

Referring to FIG. 1, a blasthole drill rig 10 includes a drill tower 14, a base 18 (e.g., a machinery house) beneath the drill tower 14 that supports the drill tower 14, an operator's cab 22 coupled to the base 18, and crawlers 26 coupled to the base 18 and driven by a crawler drive 30 that drives the drill rig 10 along a ground surface 34. The drill tower 14 is coupled to and supports a drill pipe 38 and a drill bit (not shown) disposed at an end of the drill pipe 38. The drill pipe 38 and drill bit are configured to extend vertically downward through the ground surface 34 and into a borehole (not shown). In some constructions, multiple drill pipes 38 are connected together to form an elongated drill string that extends into the borehole. The drill rig 10 also includes leveling jacks 42 to support the drill rig 10 on the surface 34, and a brace 46 that supports the drill tower 14 on the machinery house 18.

Referring to FIG. 1, the drill rig 10 also includes a drill head 50, a driving mechanism 54 coupled to the drill head 50, and an intermediate coupling 58 coupled to both the drill head 50 and the drill pipe 38. The driving mechanism 54 drives the drill head 50 to move the drill pipe 38 relative to the drill tower 14 (e.g., vertically up and down and into and out of the borehole).

Figure 2:
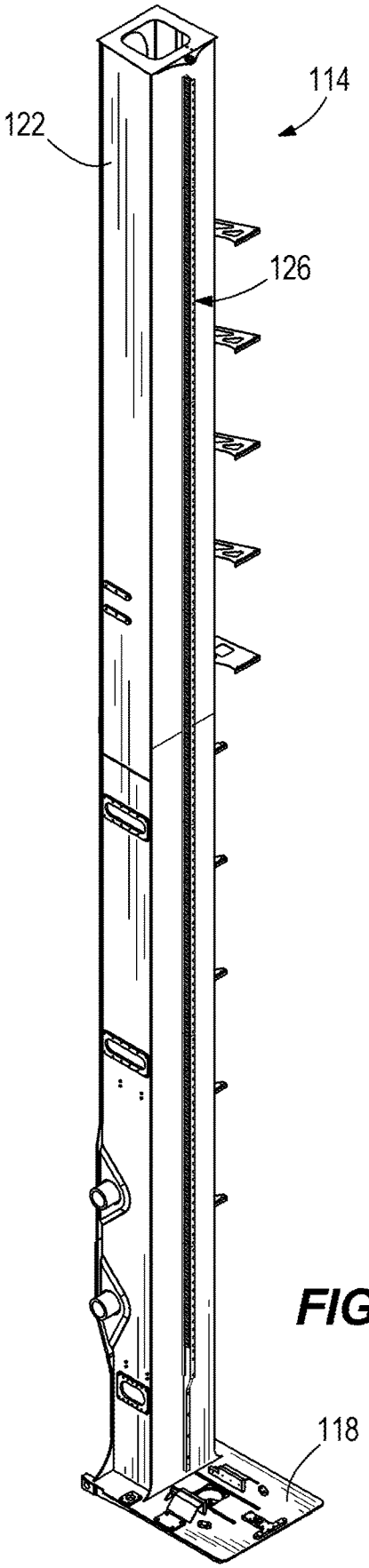
FIG. 2 is a perspective view of a mast for use on the drill rig of FIG. 1, and a rack assembly coupled to the mast.
Figure 3:
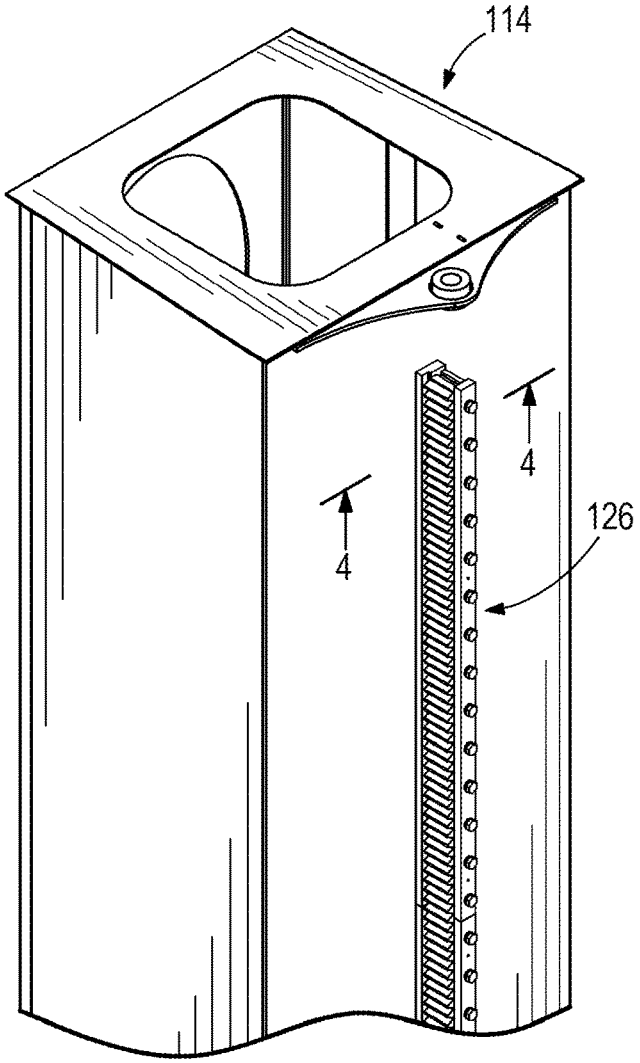
FIG. 3 is an enlarged, partial perspective view of the mast and the rack assembly.

FIGS. 2-10 illustrate a mast 114 for use with a blasthole drill rig. In some constructions the mast 114 may replace the mast 14 on the drill rig 10 in FIG. 1. As illustrated in FIG. 2, the mast 114 includes a first end 118 to be coupled to a base (e.g., the base 18), and a second opposite end 122.

FIGS. 2-10 also illustrate a rack assembly 126 coupled to the mast 114. The rack assembly 126 forms part of a driving mechanism for a blasthole drill rig, for example to linearly drive a drill pipe or drill string. For example, the rack assembly 126 may form part of the driving mechanism 54 illustrated schematically in FIG. 1, to linearly drive the drill pipe 38 (e.g., vertically up and down). In some constructions the rack assembly 126 is driven by a pinion.

Figure 4:
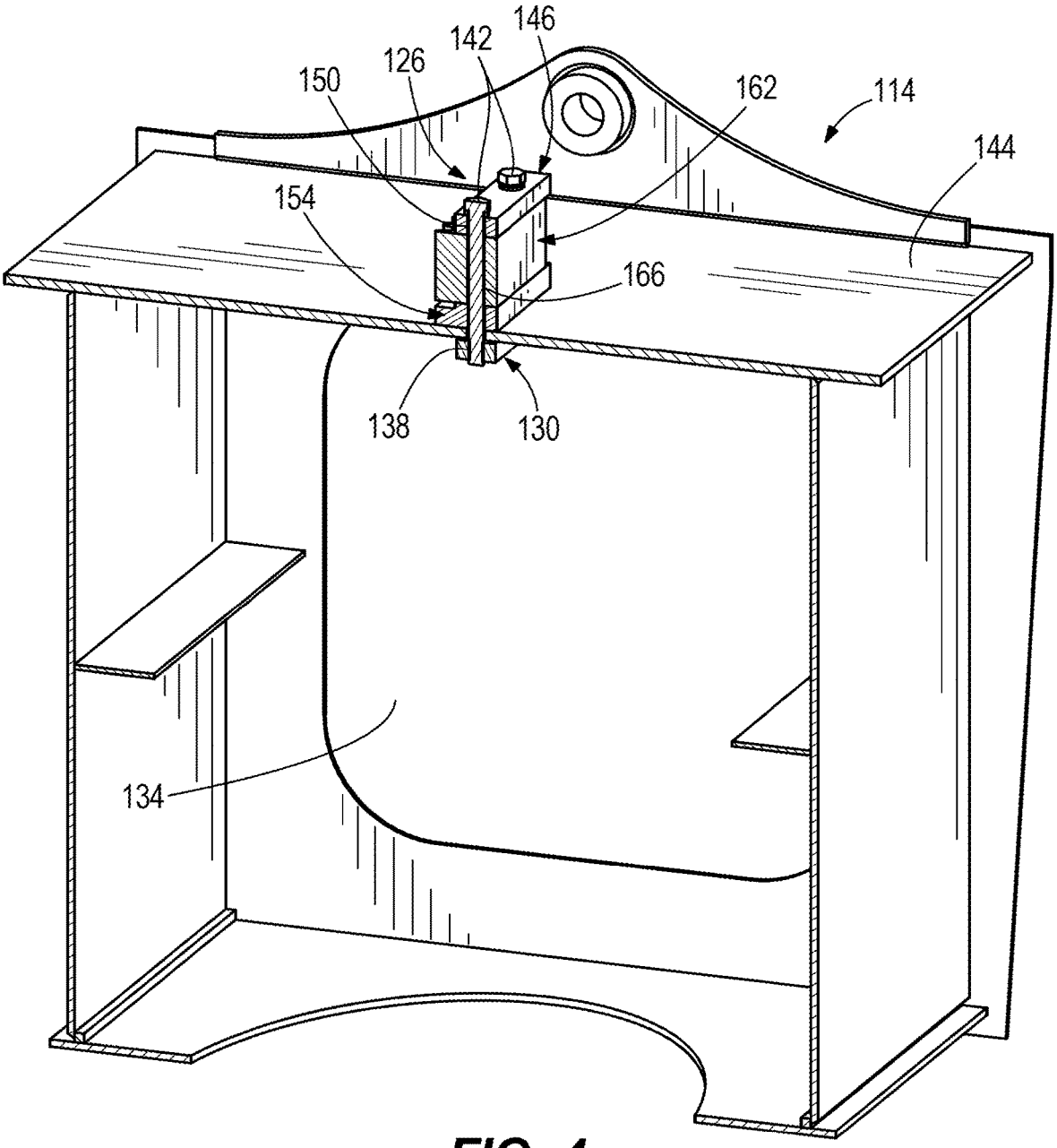
FIG. 4 is cross-sectional view of the mast and the rack assembly.

Referring to FIG. 4, the rack assembly 126 includes at least one inner member 130 positioned within an interior 134 of the mast 114. The inner member 130 includes apertures 138 to receive fasteners 142 (e.g., threaded bolts, screws, etc.). In some constructions, the inner member 130 contacts and presses against a wall 144 of the mast 114. In some constructions, the inner member 130 is integrally formed as a single piece with the wall 144 of the mast 114. In some constructions, the inner member 130 is welded to the wall 144 of the mast 114. In some constructions, the inner member 130 is removably coupled to the wall 144 of the mast 114. In the illustrated construction, the inner member 130 is an elongate bar positioned within the interior 134 of the mast 114.

Referring to FIGS. 4-7 and 9, the rack assembly 126 also includes outer rails 146. The outer rails 146 are positioned outside of the mast 114. Each outer rail 146 includes apertures 150 (FIG. 4) to receive the fasteners 142. The outer rails 146 are spaced apart from the mast 114. In the illustrated construction, the outer rails 146 are separate, elongate removable pieces.

Referring to FIGS. 4-7 and 9, the rack assembly 126 also includes inner rails 154. The inner rails 154 are positioned outside of the mast 114. Each inner rail 154 includes apertures 158 (FIGS. 4 and 9) to receive the fasteners 142. In some constructions, the inner rails 154 contact and press against the wall 144 of the mast 114. In some constructions, the inner rails 154 are integrally formed as a single piece with the wall 144 of the mast 114. In some constructions, the inner rails 154 are welded to the wall 144 of the mast 114. In some constructions, the inner rails 154 are removably coupled to the wall 144 of the mast 114. In the illustrated construction, the inner rails 154 are separate, elongate removable pieces.

Referring to FIGS. 4-8 and 10, the rack assembly 126 also includes rack segments 162. The rack segments 162 are positioned outside of the mast 114. Each rack segment 162 includes apertures 166 (FIGS. 4, 9, and 10) to receive the fasteners 142. The rack segments 162 are positioned between the outer rails 146 and the inner rails 154. In the illustrated construction, the rack segments 162 are separate, elongate removable pieces.

Figure 5:
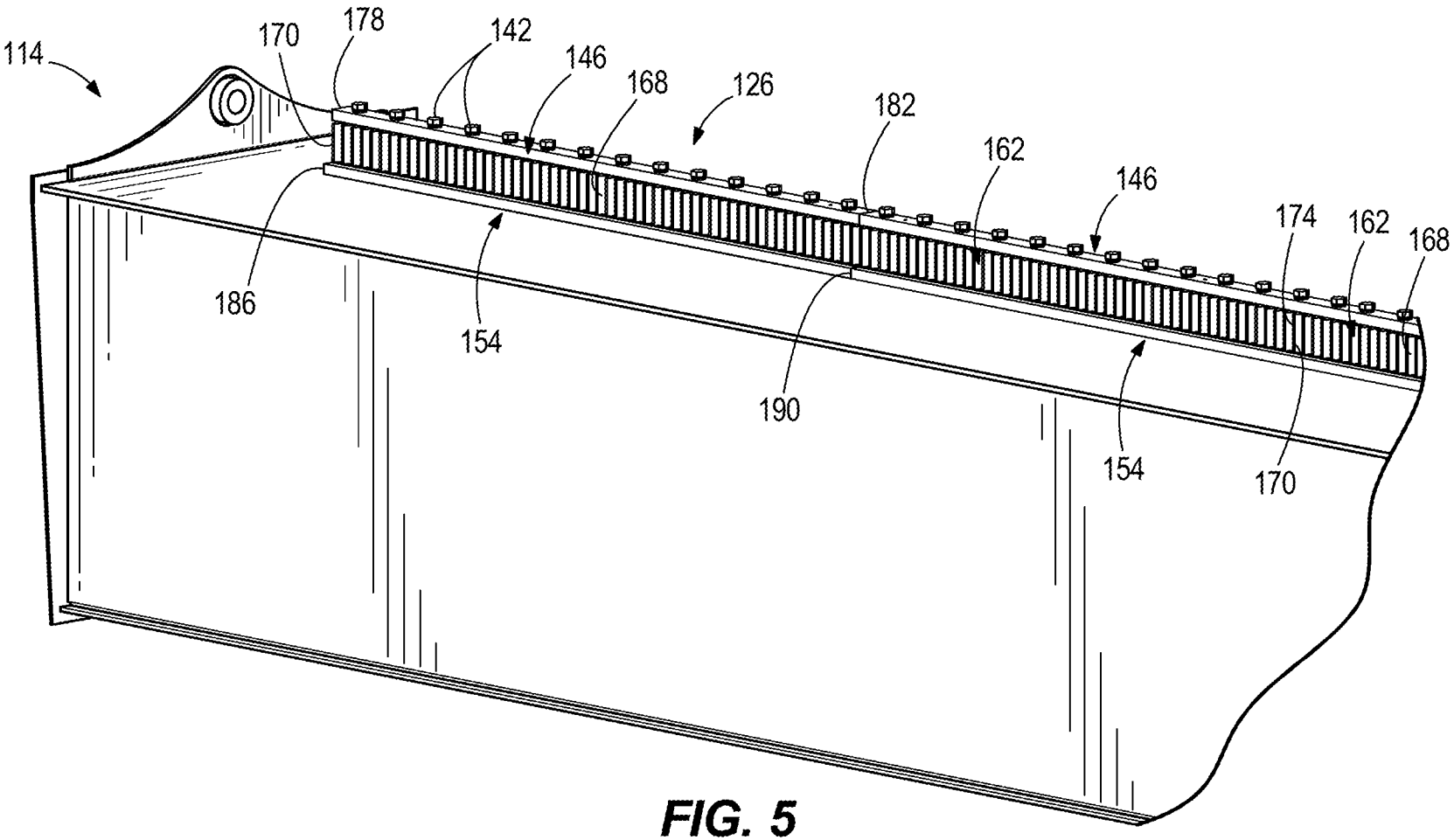
FIG. 5 is a perspective view of the mast and the rack assembly.

Referring to FIG. 5, in the illustrated construction the rack segments 162 have geared surfaces 168 to engage a pinion, so that a drill pipe (e.g., drill pipe 38) may be moved along the mast 114. Wheels, rollers, etc. (e.g., of a structure adjacent the pinion) may move along the inner rails 154 and outer rails 146 with the pinion, so that the pinion maintains a consistent engagement with the geared surfaces 168 and also remain at a consistent distance relative to the rack segments 162 (e.g., without pressing into or collapsing into the rack segments 162).

Referring to FIG. 4, each fastener 142 extends at least partially through one outer rail 146, one rack segment 162, one inner rail 154, the wall 144 of the mast 14, and the inner member 130. In some constructions multiple fasteners 142 extend toward one another through the assembly 126. For example, in some constructions one fastener 142 extends through the outer rail 146 and a portion of the rack segment 162 in one direction, and another fastener 142 extends through the inner member 130, the wall 144, the inner rail 154, and into the rack segment 162 in an opposite direction. In some constructions, the rack assembly 126 does not include the inner rails 154. Instead, the rack segments 162 directly contact and press against the wall 144 of the mast 114, and are disposed between the outer rails 146 and the wall 144 of the mast 114. In some constructions, the rack assembly 126 does not include the inner member 130. Instead, the fasteners 142 extend through the wall 144 of the mast and nuts or other structures are used to secure the fasteners 142 within the mast 114.

Figure 6:
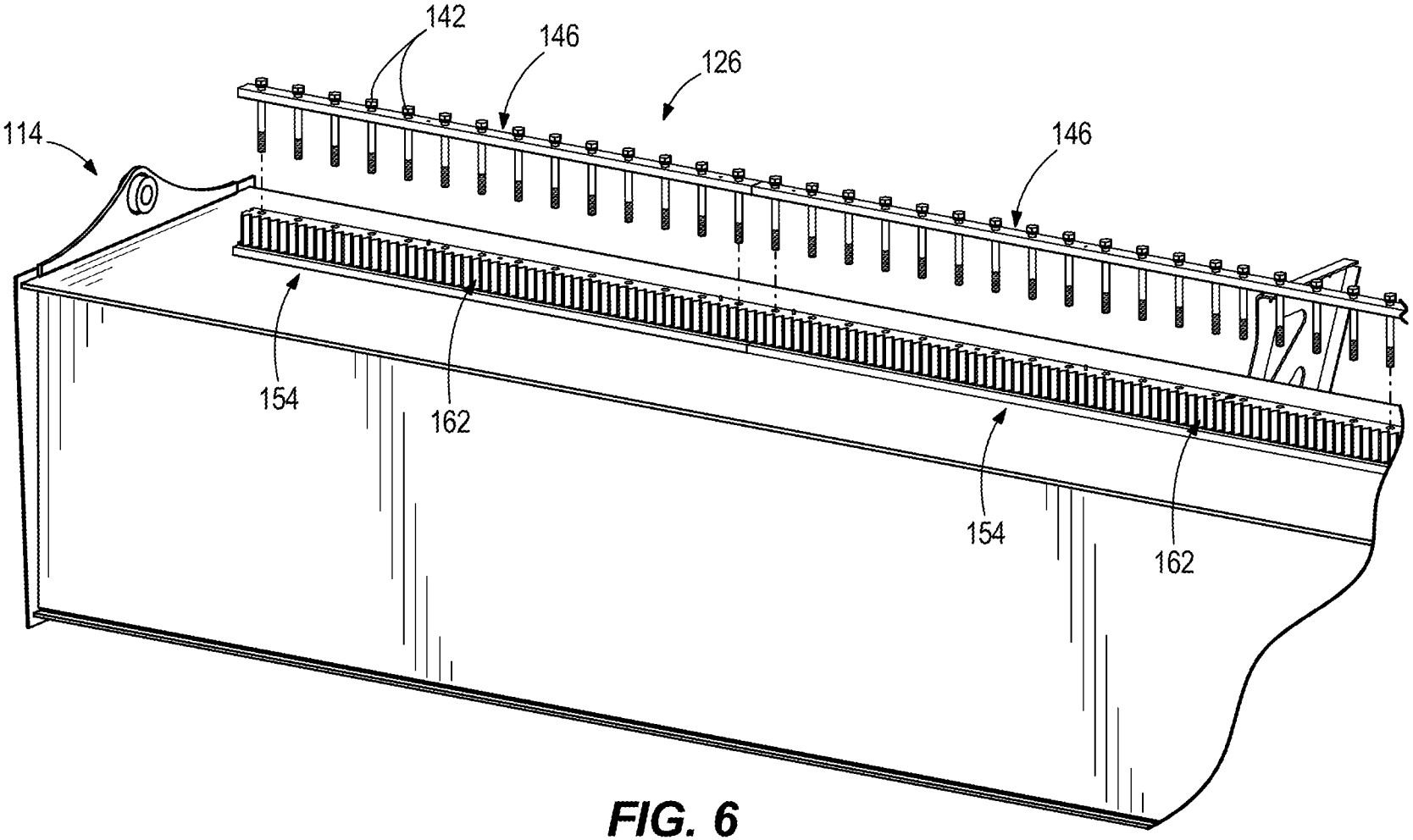
FIG. 6 is a partially exploded view of the rack assembly.
Figure 7:
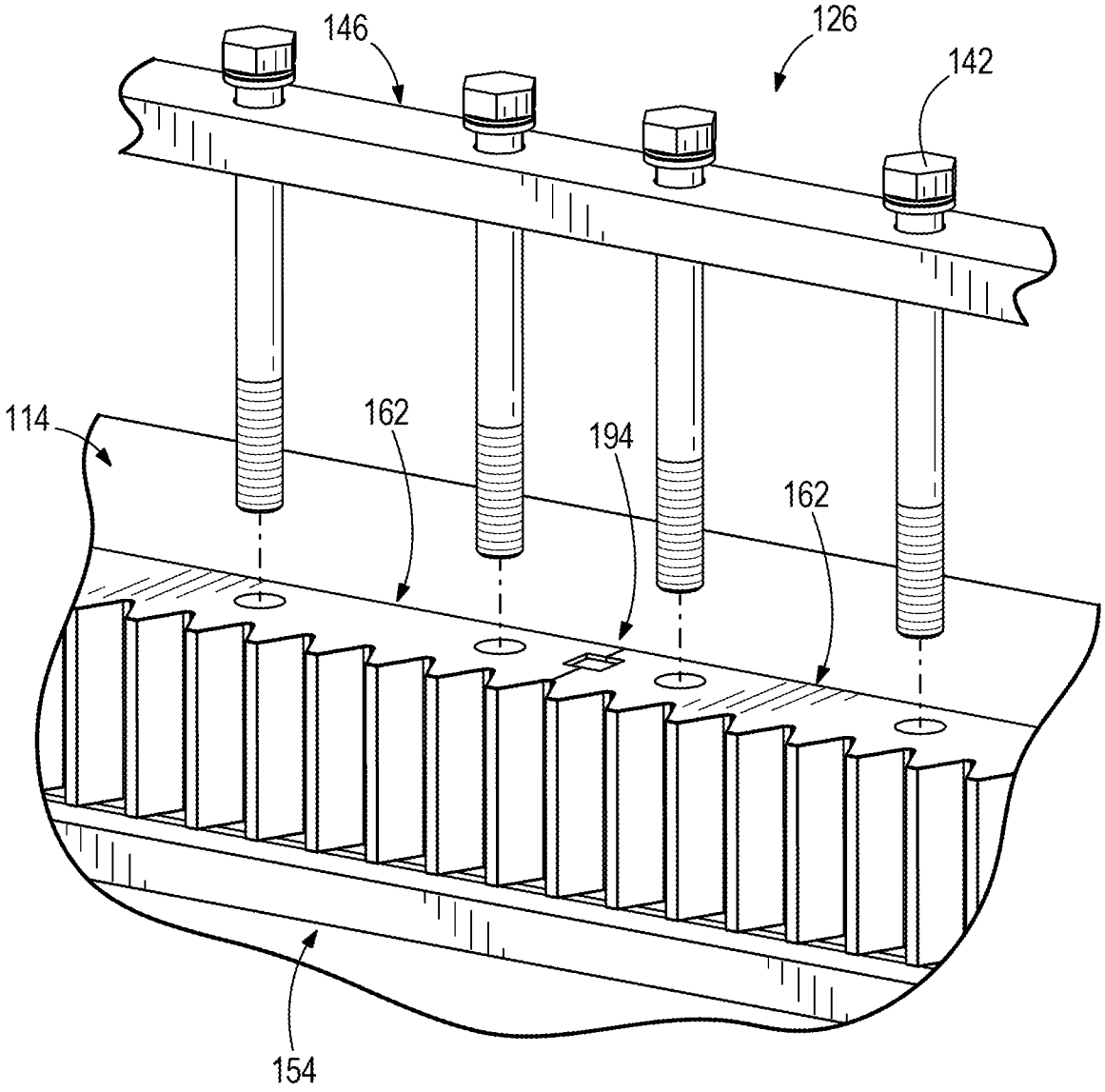
FIG. 7 is an enlarged, partially exploded view of a portion of the rack assembly.
Figure 8:
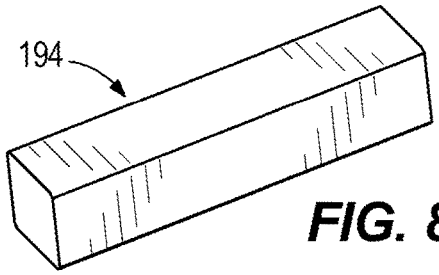
FIG. 8 is a perspective view of a key used in the rack assembly.

Referring to FIG. 2-10, the rack assembly 126 is coupled to the mast 114 by arranging the rack segments 162 next to one another along the mast 114, arranging the outer rails 146 over the rack segments 162, and inserting the fasteners 142. As illustrated in FIGS. 5 and 6, the rack segments 162 and outer rails 146 are staggered relative to one another during this arrangement. For example, as illustrated in FIG. 5, each rack segment 162 includes a first end 170 and a second end 174. Each outer rail 146 includes a first end 178 and a second end 182. The first and second ends 170, 174, 178, 182 of the rack segments 162 and the outer rails 146 alternate moving along the mast 114, such that at least some of the outer rails 146 overlap portions of two different rack segments 162. Additionally, in the illustrated construction, the inner rails 154 each include a first end 186 and a second end 190. The first ends 186 of the inner rails 154 are aligned with the first ends 178 of the outer rails 146, and the second ends 190 of the inner rails 154 are aligned with the second ends 182 of the outer rails 146. Thus, the rack segments 162 are also staggered relative to the inner rails 154. Other constructions include different arrangements and spacing than that illustrated. For example, in some constructions the inner rails 154 are not aligned identically with the outer rails 146 as shown.

Figure 9:
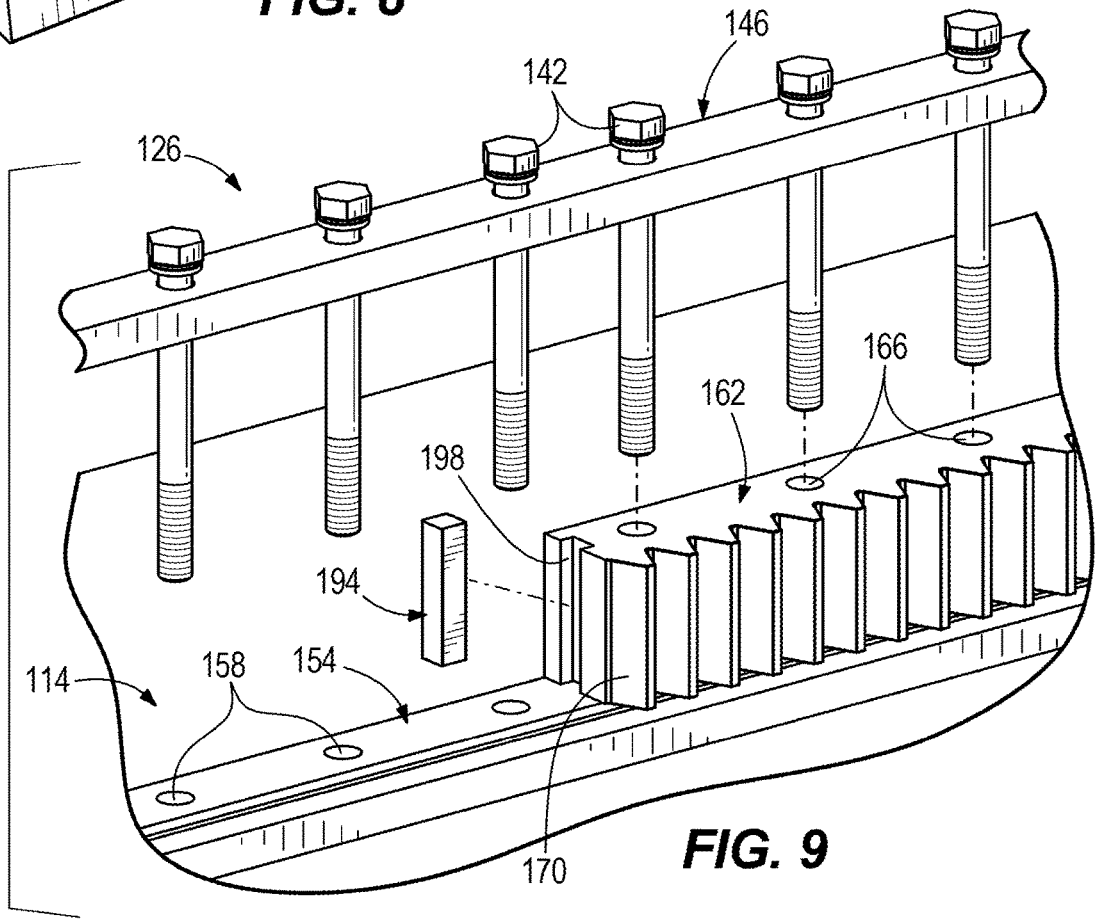
FIG. 9 is an enlarged, partially exploded view of a portion of the rack assembly, illustrating a position of the key.
Figure 10:
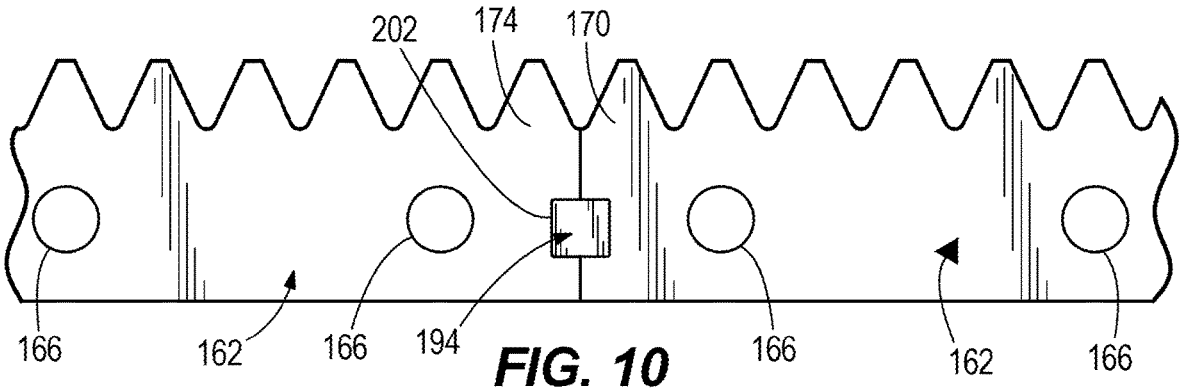
FIG. 10 is a top view of the rack assembly, illustrating use of the key to prevent lateral translation of two rack segments of the rack assembly.

Referring to FIGS. 7-10, the rack assembly 126 also includes keys 194 that are positioned between each of the rack assemblies 126. As illustrated in FIG. 9, the rack segments 162 include notches 198 at the first and/or second ends 170, 174. When the rack segments 162 are aligned next to one another along the mast 114, the notches 198 together form open chambers 202 sized and shaped to receive the keys 194. In the illustrated construction the keys 194 are generally elongate, square pins that are inserted into the chambers 202, although other constructions include different shapes and sizes than that illustrated. As illustrated in FIG. 10, the keys 194 prevent lateral translation of the rack segments 162 relative to one another along at least one direction (see double arrows in FIG. 10).

In at least some constructions, the overall use of the individual rack segments 162, outer rails 146, and fasteners 142 (and in some constructions the inner rails 154 and/or inner member or members 130) may increase an overall strength of the mast 114, reduce an overall amount of time to assemble the mast 114 and rack assembly 126, and reduce an overall amount of time to service (e.g., replace) a section of the mast 114 as compared to other rack assemblies. The rack segments 162 and outer rails 146 may easily be removed and/or replaced as desired. Additionally, by using individual outer rails 146 and rack segments 162, the cost of the overall rack assembly 126 may be reduced as compared manufacturing a single piece rack assembly 126. Furthermore, use of the various removable outer rails 146 and rack segments 162 may also result in the fasteners 142 having longer life and being more reliable.

Although the invention has been described in detail referring to certain preferred embodiments, variations and modifications exist within the scope and spirit of one or more independent aspects of the invention as described.

What is claimed is:

1. A mast and rack assembly for a blasthole drill rig, the mast and rack assembly comprising:

a mast extending along an elongate direction;

a rack assembly coupled to the mast, the rack assembly including outer rails each having a first end and a second, opposite end spaced from the first end along the elongate direction, and rack segments disposed between the outer rails and the mast, wherein each of the rack segments includes a first end and a second, opposite end spaced from the first end along the elongate direction, wherein at least one of the outer rails overlaps two of the rack segments along a direction perpendicular to the elongate direction, such that the at least one of the outer rails extends over the second end of one of the two rack segments and the first end of the other of the two rack segments.

2. The mast and rack assembly of claim 1, wherein the outer rails and the rack segments each include a plurality of apertures configured to receive fasteners.

3. The mast and rack assembly of claim 1, wherein each of the rack segments includes geared surfaces configured to engage a pinion.

4. The mast and rack assembly of claim 1, wherein the rack segments includes two rack segments, wherein the first end of one of the two rack segments and the second end of the other of the two rack segments each includes a notch, wherein the two rack segments are disposed next to one another such that the notches are aligned to form an open chamber, and wherein the mast and rack assembly further includes a key configured to be received in the open chamber to prevent lateral translation of the two rack segments relative to one another.

5. The mast and rack assembly of claim 4, wherein the key is an elongate square pin.

6. The mast and rack assembly of claim 1, wherein the rack assembly further includes inner rails, wherein the rack segments are disposed between the outer rails and the inner rails.

7. The mast and rack assembly of claim 6, wherein the mast includes a wall, and wherein the inner rails are separate elements from the mast that press against the wall of the mast.

8. The mast and rack assembly of claim 6, wherein the inner rails are integrally formed as single pieces with the mast.

9. The mast and rack assembly of claim 6, wherein each of the outer rails, the inner rails, and the rack segments include a plurality of apertures configured to receive fasteners.

10. The mast and rack assembly of claim 6, wherein at least one of the inner rails overlaps two of the rack segments.

11. The mast and rack assembly of claim 1, wherein the rack assembly includes an inner member positioned within the mast, wherein the outer rails, the rack segments, and the inner member each include a plurality of apertures configured to receive fasteners.

12. The mast and rack assembly of claim 11, wherein the inner member is an elongate bar.

13. The mast and rack assembly of claim 11, wherein the inner member is welded to a wall of the mast.

14. The mast and rack assembly of claim 11, wherein the rack assembly further includes inner rails, wherein the rack segments are disposed between the outer rails and the inner rails, and wherein a wall of the mast is disposed between at least one of the inner rails and the inner member.

15. The mast and rack assembly of claim 14, wherein the inner rails include apertures to receive the fasteners.

16. The mast and rack assembly of claim 1, wherein the rack assembly further includes inner rails, wherein the rack segments are disposed between the outer rails and the inner rails, wherein the rack assembly includes an inner member positioned within the mast, and wherein a wall of the mast is disposed between at least one of the inner rails and the inner member.

17. The mast and rack assembly of claim 16, further comprising a fastener that extends through one of the outer rails, through one of the rack segments, through one of the inner rails, through the wall of the mast, and through the inner member.

18. A blasthole drill rig comprising:

a base;

crawlers coupled to the base and configured to drive the blast hole drill;

a mast coupled to the base and extending along an elongate direction;

a drill pipe coupled to the mast; and a rack assembly coupled to the mast, the rack assembly including inner rails pressed against a wall of the mast, outer rails spaced from the inner rails, and rack segments disposed between the outer rails and the inner rails, wherein the outer rails each include a first end and a second, opposite end spaced from the first end along the elongate direction, wherein the rack segments each include a first end and a second, opposite end spaced from the first end along the elongate direction, wherein at least one of the outer rails overlaps two of the rack segments along a direction perpendicular to the elongate direction, such that the at least one of the outer rails extends over a second end of one of the two rack segments and a first end of the other of the two rack segments, and wherein at least one of the inner rails overlaps two of the rack segments.

19. The blasthole drill of claim 18, wherein the rack segments includes two rack segments, wherein the first end of one of the two rack segments and the second end of the other of the two rack segments each includes a notch, wherein the two rack segments are disposed next to one another such that the notches are aligned to form an open chamber, and wherein the mast and rack assembly further includes a key configured to be received in the open chamber to prevent lateral translation of the two rack segments relative to one another.

20. The blasthole drill of claim 19, wherein the key is an elongate square pin.

21. The blasthole drill of claim 18, wherein the rack assembly includes an inner member positioned within the mast, wherein the outer rails, the inner rails, the rack segments, and the inner member each include a plurality of apertures configured to receive fasteners.

22. The blasthole drill of claim 21, wherein the inner member is an elongate bar.

23. A rack assembly for a mast on a blasthole drill rig, the rack assembly comprising:

outer rails each having a first end and a second, opposite end spaced from the first end along an elongate direction; and rack segments configured to be coupled to the outer rails, wherein each of the rack segments includes a first end and a second, opposite end spaced from the first end along the elongate direction, wherein at least one of the outer rails is configured to overlap two of the rack segments along a direction perpendicular to the elongate direction, such that the at least one of the outer rails extends over the second end of one of the two rack segments and the first end of the other of the two rack segments.

24. The rack assembly of claim 16, wherein the rack segments includes two rack segments, wherein the first end of one of the two rack segments and the second end of the other of the two rack segments each includes a notch, wherein the two rack segments are configured to be disposed next to one another such that the notches are aligned to form an open chamber, and wherein the mast and rack assembly further includes a key configured to be received in the open chamber to prevent lateral translation of the two rack segments relative to one another.

* * * * *